US005906157A

United States Patent [19]

Mazumder

[11] Patent Number: 5,906,157

[45] Date of Patent: May 25, 1999

[54] HIGH SPEED IMPACT PRINT HAMMER

[75] Inventor: Ali T. Mazumder, Oklahoma City, Okla.

[73] Assignee: BancTec, Inc., Dallas, Tex.

[21] Appl. No.: 09/073,883

[22] Filed: May 6, 1998

[51] Int. Cl.[6] ..... B41J 9/00

[52] U.S. Cl. ..... 101/93.48; 101/93.29

[58] Field of Search ..... 101/93.48, 93.29, 101/93.34

[56] References Cited

U.S. PATENT DOCUMENTS

| | | | |
|---|---|---|---|
| 3,279,362 | 10/1966 | Helms | 101/93.34 |
| 3,643,595 | 2/1972 | Helms et al. | 101/93.34 |
| 4,236,842 | 12/1980 | Dick et al. | 101/93.48 X |
| 4,522,122 | 6/1985 | Mazumder | 101/93.02 |
| 4,530,280 | 7/1985 | Kaneko et al. | 101/93.02 |
| 4,538,930 | 9/1985 | Dunfield | 400/144.2 |
| 4,821,639 | 4/1989 | Carrington et al. | 101/93.14 |
| 4,833,981 | 5/1989 | Jezbera | 101/93.29 |
| 4,852,481 | 8/1989 | Kobryn et al. | 101/93.48 |
| 5,383,399 | 1/1995 | German | 101/93.29 X |

*Primary Examiner*—Edgar Burr
*Assistant Examiner*—Minh H. Chau
*Attorney, Agent, or Firm*—Locke Liddell & Sapp LLP

[57] ABSTRACT

An impact hammer assembly for a high speed printer includes first and second permanent magnets having opposite poles disposed adjacent to each other and having a gap therebetween. The magnets create flux lines extending across the gap. A print hammer includes a hammer beam and a hammer head. The print hammer is movable between a rest position and a print position. The hammer beam is disposed in the gap between the first and second magnets. A coil is disposed on the hammer beam and perpendicular to the magnetic flux lines. Circuitry generates a current in the coil and controls the direction of current flow in the coil, such that when current flows in the coil in a first direction, the print hammer moves towards the print position and when current flows in the coil in a second direction, opposite to the first direction, the print hammer moves towards the rest position.

1 Claim, 3 Drawing Sheets

HIGH SPEED IMPACT PRINT HAMMER

TECHNICAL FIELD OF THE INVENTION

The present invention relates to printers, and more particularly to an electromagnetically operated print hammer assembly for high speed impact printers.

BACKGROUND OF THE INVENTION

MICR symbols, characters printed with magnetic ink, are key elements which carry information utilized to process financial documents. There are several advantages of using MICR symbols. In addition to the uniqueness of the character shape for both human and machine readability, prints with magnetic ink are immune to many different types of external interferences of a non-magnetic nature. These external interferences include, for example, signatures on a bank check, extraneous marks, and pictorial backgrounds on a bank check, all of which make character recognition difficult when non-magnetic data capture techniques are used.

There are various methods and techniques, both impact and non-impact, for printing MICR characters. For high speed MICR printing to achieve high thruput and good printing quality for higher read rates, using mixed documents (different sizes and weights as used in financial institutions), the impact technology is the most suitable and successful printing method. However, impact printing technology relying on electro-mechanical devices have limitations. Frequency limitation of the electro-mechanical devices are limiting factors that control the printing speed and thus the thruput rate of high speed MICR printing systems.

A need has thus arisen for a high speed impact hammer that reduces cycle time of the impacting device, thereby increasing operating speed of the impact hammer resulting in a system capable of higher thruput rates.

SUMMARY OF THE INVENTION

In accordance with the present invention, an impact hammer assembly for a high speed printer is provided. The assembly includes first and second permanent magnets having opposite poles disposed adjacent to each other and having a gap therebetween. The magnets create flux lines extending across the gap. A print hammer includes a hammer beam and a hammer head. The print hammer is movable between a rest position and a print position. The hammer beam is disposed in the gap between the first and second magnets. A coil is disposed on the hammer beam and perpendicular to the magnetic flux lines. Circuitry is provided for generating a current in the coil and for controlling the direction of current flow in the coil, such that when current flows in the coil in a first direction, the print hammer moves towards the print position and when current flows in the coil in a second direction, opposite to the first direction, the print hammer moves towards the rest position.

BRIEF DESCRIPTION OF THE DRAWINGS

For a more complete understanding of the present invention and for further advantages thereof, reference is now made to the following Description of the Preferred Embodiments taken in conjunction with the accompanying Drawings in which.

DESCRIPTION OF THE PREFERRED EMBODIMENTS

Figure 1:
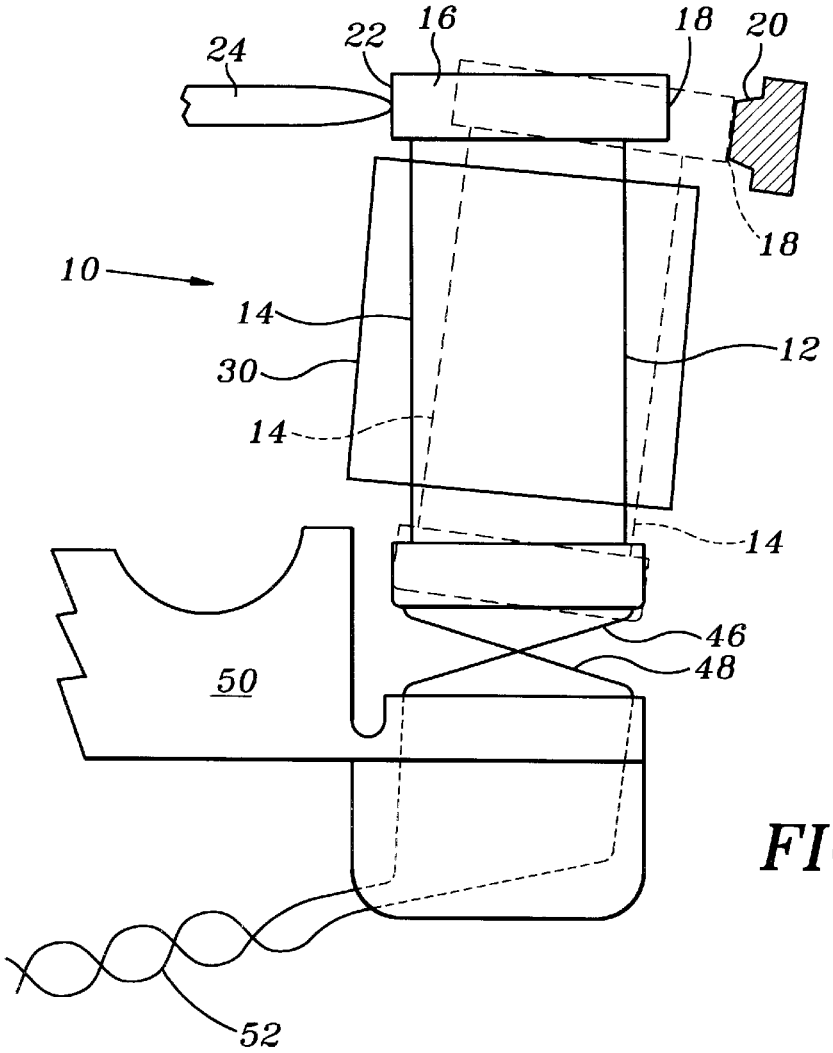
FIG. 1 is a schematic side view of an impact hammer assembly in accordance with the present invention illustrated in the rest and print positions.
Figure 2:
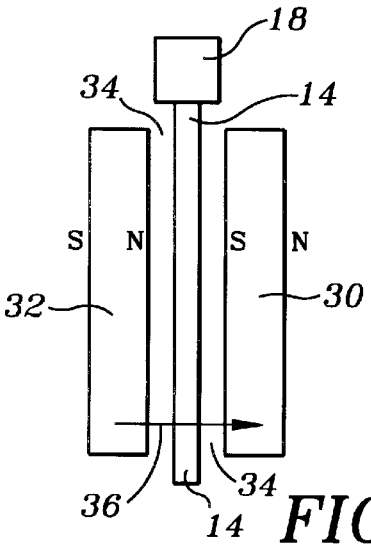
FIG. 2 is a simplified end view of the present impact hammer assembly.
Figure 3:
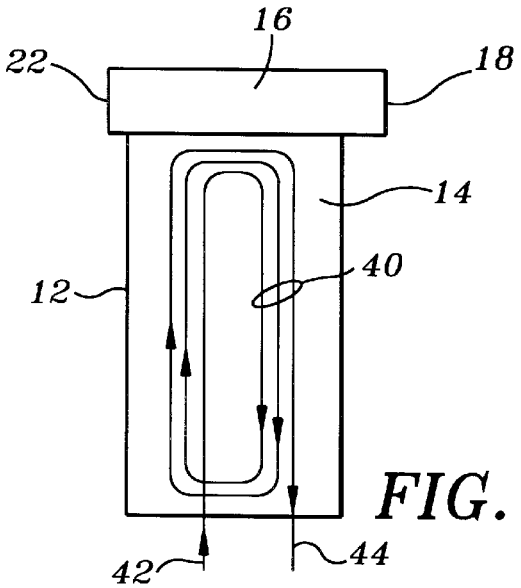
FIG. 3 is a side view of the present print hammer and coil.

Referring simultaneously to FIGS. 1–3, the present impact print hammer assembly is illustrated, and is generally identified by the numeral 10. Assembly 10 includes a print hammer 12 having a hammer beam 14 and a hammer head 16. Hammer head 16 includes a tip 18 for engaging a character 20 disposed on a die (not shown) in a print position, illustrated in the dotted lines of FIG. 1. A rear end 22 of hammer head 16 engages a backstop 24, as illustrated in the solid lines of FIG. 1, in a rest position of hammer head 16.

Impact print hammer assembly 10 further includes permanent magnets 30 and 32. Magnets 30 and 32 are disposed adjacent to each other, such that opposite north and south poles are adjacently disposed. A gap 34 is created between magnets 30 and 32. Magnetic flux, indicated by arrow 36 extends across gap 34. Hammer beam 14 is disposed within gap 34 and is perpendicular to the flux lines generated by magnets 30 and 32.

As more clearly illustrated in FIG. 3, disposed on hammer beam 14 is a coreless coil 40 disposed on the surface of hammer beam 14. Coil 40 includes terminals 42 and 44. Attached to terminals 42 and 44 is are deflection springs 46 and 48 which mount print hammer 12 to a housing 50. Magnets 30 and 32 are also mounted to housing 50. Coil 40 is energized via springs 46 and 48 from a power connection 52.

In operation of the present impact print hammer assembly 10, when coil 40 is electrically energized, and if magnetic flux lines intersect coil 40 at right angles, then the physical motion of hammer beam 14 containing coil 40 will take place in a direction perpendicular to both the direction of the current in coil 40 and the magnetic flux lines between magnets 30 and 32. The velocity of tip 18 and the resulting impact force will depend on the mass of hammer head 16, the stiffness of springs 46 and 48, the ampere turns on coil 40, the number of magnetic flux lines intersecting coil 40, and the duration for which coil 40 is energized. Print hammer 12 will accelerate, if energized for an extended period of time, until print head 16 reaches the maximum velocity which depends on the factors identified above. From that point onward, hammer head 16 will travel with a constant velocity until any physical restrictions are encountered. In the idle condition, power is removed from coil 40 and hammer head 16 rests against back stop 24. The direction of motion of hammer head 16 and tip 18 depends on the direction of current flow in coil 40 and the flux path. Change in direction of current flow in coil 40 changes the direction of motion of hammer head 16.

For good print quality, hammer head 16 is energized for a certain length of time to achieve an optimum velocity, and then power is removed from coil 40 before the hammer head 16 travels the full flight distance. The optimum velocity is determined by the impact force required to achieve maximum ink transfer from the MICR ribbon and provide quality prints. As a result, hammer head 16 travels some distance due to the velocity achieved prior to cutoff of power to coil 40. This free flight distance helps to male a softer impact to achieve uniform distribution on MICR prints and the free flight distance also helps avoid debossment on the document.

After impact, the force of reaction which is equal in magnitude and opposite in direction, causes hammer head 16 to move in the opposite direction towards backstop 24. If hammer head 16 is not driven toward backstop 24, hammer head 16 will strike the backstop 24 and move forward again, and depending on the length of the flight distance and the inertial energies retained, tip 18 may male secondary or multiple impacts before hammer head 16 comes to rest. In other words, hammer head 16 will oscillate for a significant length of time before hammer head 16 comes to a complete stop. This oscillation causes unwanted ink marks on the document and results in unacceptable print qualities. If hammer head 16 is energized during the unsettled condition, print quality is also unacceptable. The cycle time of hammer head 16 is defined as the time taken by the hammer 12 when the power is applied and the hammer 12 completes the forward motion phase, impact phase, and return phase at the end of which time the hammer 12 completely comes to rest. At that point the hammer can safely be fired for the next printing event. When no damping is applied to hammer head 16, the cycle time can be long. The present invention significantly reduces the cycle time and brings the hammer head 16 to a complete rest and settled condition to achieve a frequency of operation of twice normally achieved in impact print hammer assemblies. By changing the direction of current in coil 40, hammer head 16 is quickly driven to the rest position at backstop 24.

Figure 4:
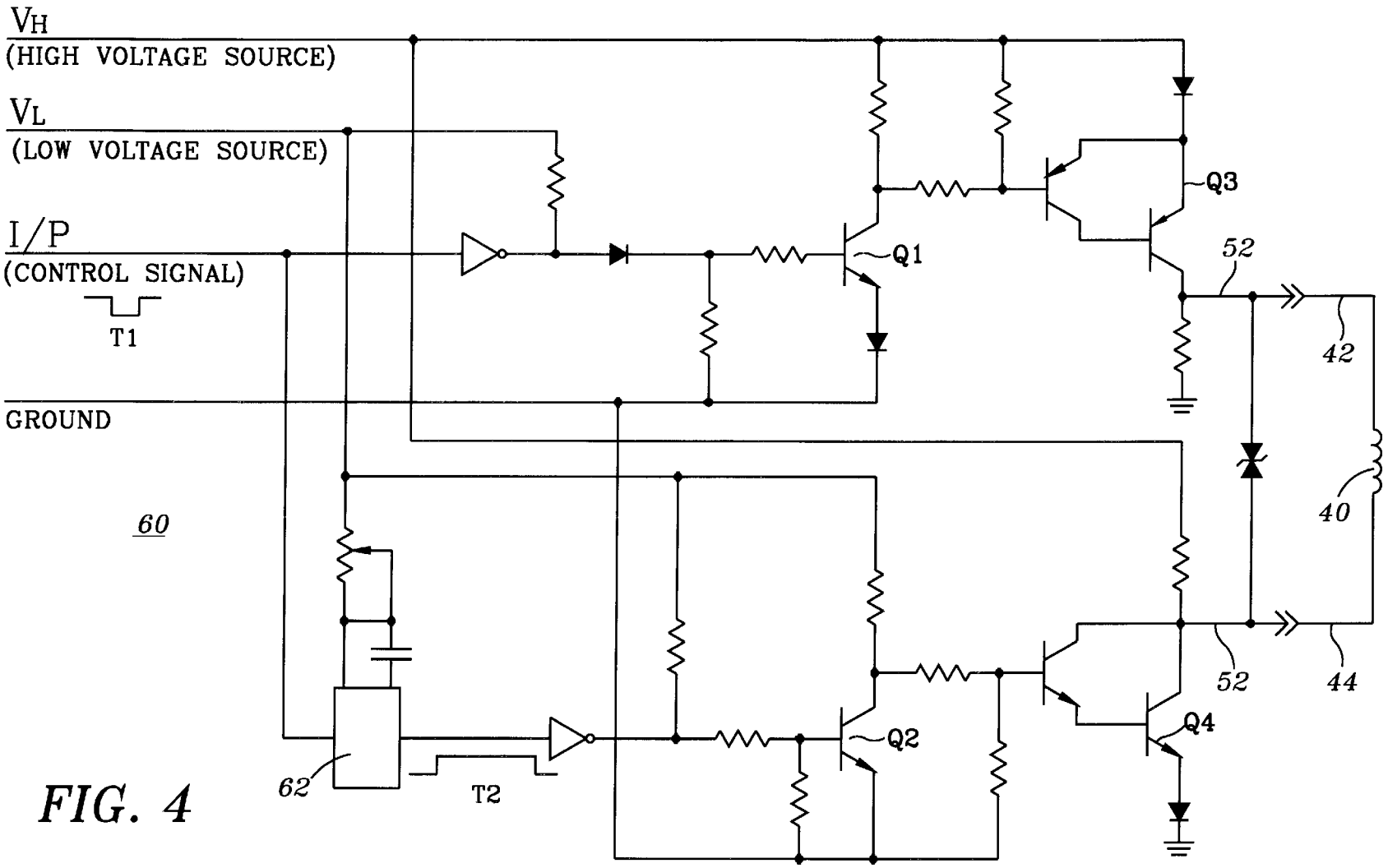
FIG. 4 is a schematic circuit diagram of a control circuit for energizing the present print hammer assembly.

Referring to FIG. 4, a control circuit for the present print hammer assembly 10 is illustrated, and is generally identified by the numeral 60. Control circuit 60 provides power to coil 40 to thereby generate current in either a forward or reversed biased direction. In the idle condition, print hammer 12 is operated from a high voltage source, VH. Terminal 42 is connected to switched high voltage source while terminal 44 is connected to switched low voltage power or ground. Under this condition, print hammer 12 is reversed biased for backward motion toward backstop 24. Therefore, hammer 12 rests against backstop 24. In the idle state, in absence of control signal, signal line I/P remains high. This condition switches a transistor Q1 and a transistor Q3 off. Therefore, terminal 42 of coil 40 is connected to low voltage source VL.

The high state of the I/P signal keeps the output of a timer 62 in a low state and thus turns a transistor Q2 on and a transistor Q4 off. As a result, terminal 44 of hammer coil 40 is connected to the high voltage source. Under this condition, print hammer 12 rests against backstop 24 and is held in a backward position. This condition inhibits any forward motion or oscillations or extraneous disturbances, and print hammer 12 is in a complete settled condition.

Figure 5:
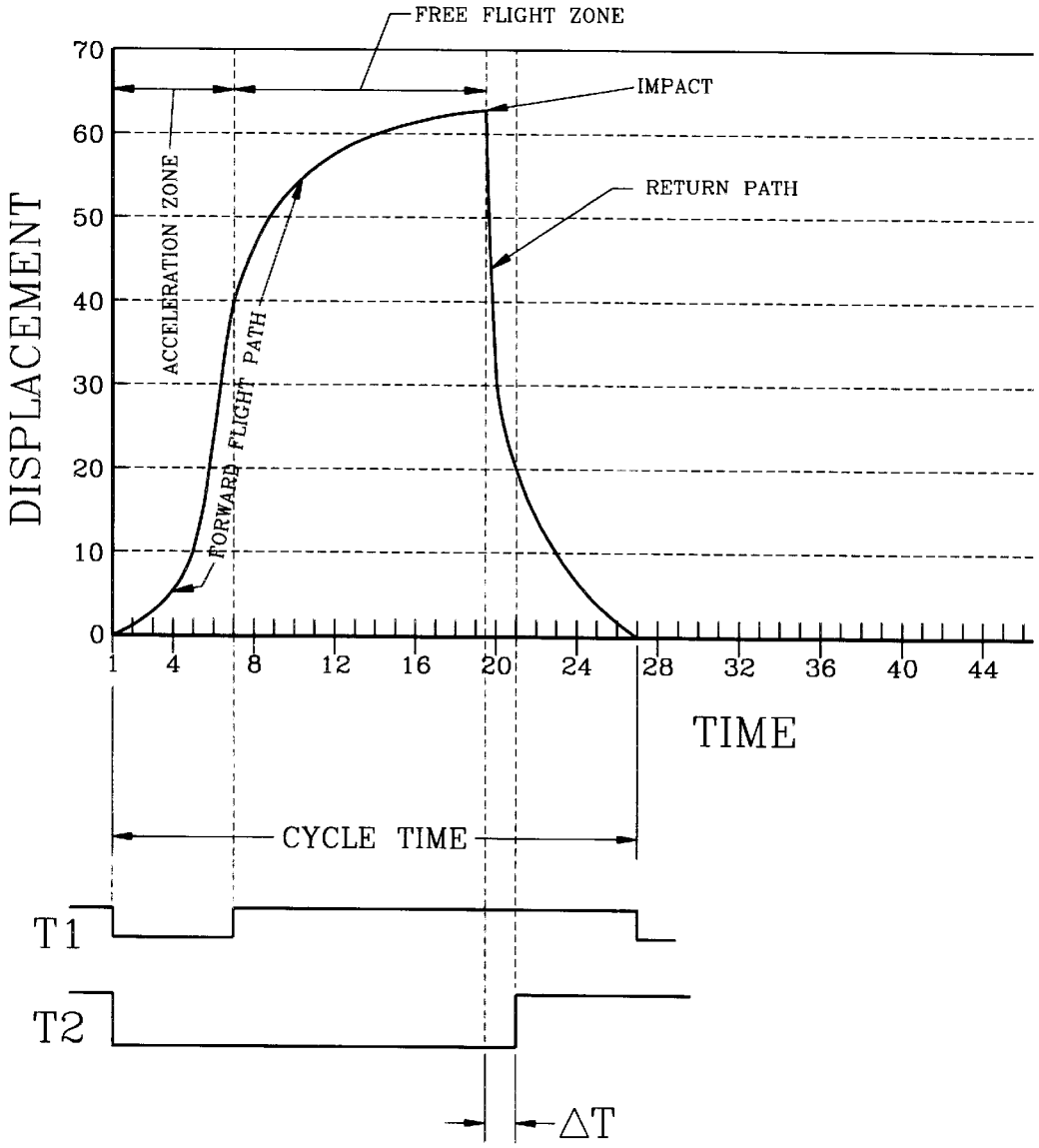
FIG. 5 is a graphical representation illustrating operation of the present impact hammer assembly.

When a print command is issued, the I/P signal goes low for the duration T1 (FIG. 5). This condition causes switching transistor Q1 to turn on which turns transistor Q3 on. As a result, the energy supplied to terminal 42 of coil 40 changes from power ground to the high voltage source. The negative edge of the I/P signal activates timer 62 and the output of timer 62 goes high for the duration T2. The high output during time T2 switches the transistor Q2 to off which in turn switches the power transistor Q4 on. This condition causes terminal 44 of coil 40 to be connected to the low voltage source or power ground. The current now flows in the opposite direction in coil 40 compared to the current direction in the idle condition. The direction of current flow is such that hammer head 16 now moves in the forward direction. When the duration T1 of the I/P signal expires, signal I/P returns to the high state and terminal 42 of coil 40 returns to the low state. As a result, hammer head 16 is deenergized and begins a free flight phase. The duration of T2 is long enough so that hammer head 16 remains de-energized during the free flight phase. At the end of the free flight phase, hammer head 16 makes the impact with character 20 and prints the desired symbol on the document.

The duration of signal T2 is such that it extends beyond the impact point of tip 18 of hammer head 16. When the signal T2 ends and goes back to the high state, terminal 44 of coil 40 changes from the high voltage to the low voltage source, and the direction of current flow in coil 40 is reversed. Hammer head 16 is pulled back at high speed to the rest position and held in the rest position because the current in coil 40 is flowing in the opposite direction. Such a reversed bias state allows the hammer to remain in a stable condition and inhibits any forward motion or oscillations. Hammer head 16 is then ready to begin a new cycle from a stable condition. The cycle time of hammer head 16 is controlled by the duration of timer signal T2 generated by timer 62. As FIG. 5 illustrates, the cycle time of hammer head 16 includes signals T1 and T2. The duration of signal T2 is longer than the time required by hammer head 16 to make an impact in order to improve overall print quality.

It therefore can be seen that the present invention reduces the cycle time of an electro-mechanical print hammer assembly by using a reverse bias technique in order to move a print hammer head in the opposite, backward direction from the direction of printing. This reversed bias condition settles the print hammer head quickly so that a new impact cycle can begin.

Whereas the present invention has been described with respect to specific embodiments thereof, it will be understood that various changes and modifications will be suggested to one skilled in the art and it is intended to encompass such changes and modifications as fall within the scope of the appended claims.

I claim:

1. An impact hammer assembly for a high speed printer, the assembly comprising:

first and second permanent magnets having opposite poles disposed adjacent to each other and having a gap therebetween, said first and second magnets generating flux lines extending across said gap;

a print hammer having a hammer beam and a hammer head, said print hammer being movable between a rest position and a print position, said hammer beam being disposed in said gap between said first and second permanent magnets;

a coil disposed on said hammer beam, said coil being perpendicularly disposed to said magnetic flux lines;

means for generating a current in said coil and for controlling the direction of said current in said coil, such that when current flows in said coil in a first direction, said print hammer moves towards said print position and when current flows in said coil in a second direction, opposite to said first direction, said print hammer moves towards and is held in said rest position;

means for controlling said current in said coil to terminate said current in said first direction prior to said print hammer reaching said print position; and means for controlling said current in said coil to reduce said current in said second direction prior to said print hammer reaching said rest position and for maintaining said reduced current in said second direction until current flows in said first direction.

* * * * *